US009533318B2

(12) United States Patent
Galbraith et al.

(10) Patent No.: US 9,533,318 B2
(45) **Date of Patent: *Jan. 3, 2017**

(54) FLAMELESS THERMAL SPRAY SYSTEM USING FLAME HEAT SOURCE

(71) Applicant: Resodyn Corporation, Butte, MT (US)

(72) Inventors: Stephen L. Galbraith, Butte, MT (US); Lawrence C. Farrar, Butte, MT (US)

(73) Assignee: Resodyn Corporation, Butte, MT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/508,357

(22) Filed: Oct. 7, 2014

(65) Prior Publication Data

US 2015/0182980 A1 Jul. 2, 2015

Related U.S. Application Data

(63) Continuation of application No. 12/657,211, filed on Jan. 14, 2010, now Pat. No. 8,857,733.

(60) Provisional application No. 61/205,079, filed on Jan. 14, 2009.

(51) Int. Cl.

| | |
|---|---|
| ***B05B 7/20*** | (2006.01) |
| ***B05B 7/16*** | (2006.01) |
| ***B05B 7/14*** | (2006.01) |
| ***C23C 4/12*** | (2016.01) |
| ***B05D 1/08*** | (2006.01) |

(52) U.S. Cl.

CPC ..... *B05B 7/1626* (2013.01); *B05B 7/1486* (2013.01); *B05D 1/08* (2013.01); *C23C 4/12* (2013.01); *C23C 4/129* (2016.01)

(58) Field of Classification Search

CPC ..... B05B 7/205; B05B 7/0006; B05B 7/16; B05B 7/1606; B05B 7/1613; B05B 7/162; B05B 7/1626; B05B 7/14; B05B 7/148; B05B 7/1486; B05D 1/00; B05D 1/02; B05D 1/08; B05D 1/10; B05D 1/12; C23C 4/00; C23C 4/12; C23C 4/129

USPC ..... 239/79–82, 85, 132, 132.1, 132.3, 239/132.5, 419, 419.3, 419.5, 422, 423, 239/427, 427.3, 427.5, 428

See application file for complete search history.

(56) References Cited

U.S. PATENT DOCUMENTS

| | | | |
|---|---|---|---|
| 2,092,150 | A | 9/1937 | Bieakley |
| 3,801,020 | A | 4/1974 | Mocarski |
| 3,958,758 | A | 5/1976 | Piorkowski |
| 4,416,421 | A | 11/1983 | Browning |
| 4,694,990 | A | 9/1987 | Karlsson et al. |
| 5,041,713 | A | 8/1991 | Weidman |

(Continued)

FOREIGN PATENT DOCUMENTS

| | | | |
|---|---|---|---|
| DE | 102005063145 | A1 | 7/2007 |
| EP | 0492384 | A1 | 7/1992 |

OTHER PUBLICATIONS

US Notice of Allowance in U.S. Appl. No. 12/657,211 dated Jun. 10, 2014.

(Continued)

*Primary Examiner* — Christopher Kim

(74) *Attorney, Agent, or Firm* — McDermott Will & Emery LLP

(57) ABSTRACT

An apparatus and method for forming a fusible coating or structure comprising a combustor that is operative to combust a fuel and contain the resulting flame to produce combustion products; means for cooling the combustion products to produce a hot carrier gas stream; and means for introducing fusible material into the hot carrier gas stream.

18 Claims, 12 Drawing Sheets

(56) References Cited

U.S. PATENT DOCUMENTS

| | | | | |
|---|---|---|---|---|
| 5,047,265 | A | 9/1991 | Simm | |
| 5,207,382 | A | 5/1993 | Simm | |
| 5,236,327 | A | 8/1993 | Flanagan et al. | |
| 5,285,967 | A | 2/1994 | Weidman | |
| 5,503,872 | A | 4/1996 | MacKenzie et al. | |
| 5,520,334 | A * | 5/1996 | White | 239/85 |
| 7,216,814 | B2 | 5/2007 | Gardega | |
| 8,857,733 | B1 * | 10/2014 | Galbraith et al. | 239/79 |
| 2004/0180192 | A1 | 9/2004 | Heinrich et al. | |
| 2006/0166153 | A1 | 7/2006 | Rusch et al. | |
| 2008/0110173 | A1 | 5/2008 | Bunker | |
| 2009/0095823 | A1 | 4/2009 | Gardega | |

OTHER PUBLICATIONS

US Office Action in in U.S. Appl. No. 12/657,211 dated Dec. 6, 2012.

US Office Action in in U.S. Appl. No. 12/657,211 dated Jul. 17, 2013.

* cited by examiner

FLAMELESS THERMAL SPRAY SYSTEM USING FLAME HEAT SOURCE

CROSS-REFERENCE TO RELATED APPLICATIONS

This application is a continuation application of U.S. patent application Ser. No. 12/657,211, filed on Jan. 14, 2010, which claims the benefit of U.S. Provisional Patent Application No. 61/205,079, filed Jan. 14, 2009, the contents of each of which are incorporated herein by reference in their entirety.

STATEMENT REGARDING FEDERALLY SPONSORED RESEARCH OR DEVELOPMENT

The U.S. Government has a paid-up license in this invention and the right in limited circumstances to require the patent owner to license others on reasonable terms as provided for by the terms of Grant No. FA8651-04-C-0379 awarded by the United States Air Force.

BACKGROUND

This invention relates to the formation of fusible coatings or structures (e.g., polymer or polymer composite coatings, or reinforced polymer coatings, as well as polymer, or reinforced polymer structures) via a thermal spray process. In particular, the invention relates to formation of these coatings or structures using a flameless thermal spray process.

Polymer thermal spray systems have been used for depositing thermoplastic, thermoset and radiation-curable materials onto substrates for several decades. Generally, a flame or plasma is projected from a tube and a stream of the polymer (or other fusible powder) is introduced into the projected flame or plasma. In the flame or plasma, the polymer particles are heated and melted, and when they impinge on the surface, they "splat" (flatten) and fuse together to form a more or less continuous coating.

A commercial thermal spray system that uses a gas flame that is available from Xiom, Inc. (Babylon, N.Y.) is the XIOM 5000 Scorpion and the XIOM 1000. Similar units are or have been available from Alamo Supply Company, LTD (Houston, Tex.), model number ASC PG-550, Plastic Flamecoat Systems, Inc (Big Springs, Tex.), Applied Polymer Systems (Boynton Beach, Fla.), and Sulzer Metco, Winterthur, AG, Switzerland.

One major difficulty is the flame or plasma itself. Many polymers degrade in a flame, even when exposed to it for a very short time. In addition, the flame impinging on the target surface can degrade that surface as well. The degradation resulting from oxidation and/or breaking of polymer bonds causes reduction in the physical properties of polymers, as well as the potential inclusion of defects in polymer coatings that are deleterious to their performance or appearance, e.g., burned particles, carbon inclusions, yellowing and discoloration, pinhole defects. As such it is important that thermal methods used to melt, deposit and process polymers as coatings and/or structures do not subject the polymers to harsh oxidation, radical or reactive ion environments that cause charring, or to high temperatures that break or weaken polymer bonds. Thus, the application of polymers for many applications should use the minimum amount of heat during the process in order to preserve the physical properties of the polymers being applied.

The degradation processes related to the use of flames are related to the nature of flames. Flames induce combustion which is a highly exothermic self-sustaining oxidation reaction that in turn produces high temperature flames. The temperature of a flame is primarily dependent on the type of fuel involved in the combustion process and typically ranges from about 1,400 degrees Centigrade (° C.) for a candle to more than 3,000° C. for an oxyacetylene torch. The high temperature of the flame tears apart the vaporized fuel molecules, forming various combustion products and free radicals which react with each other and with the oxidizer involved in the reaction. The high energy of the flame also excites the electrons in some of the transient reaction intermediates such as CH and C2, which results in the emission of visible light as these substances release their excess energy.

The visible part of a flame is extremely rich with chemical reactions and intermediate species, mostly radicals. For example, it has been reported that combustion of natural gas can be modeled using 53 species and 325 elementary reactions. As the temperature decreases beyond the visible part of a flame, most of the highly reactive radicals and ions recombine into less reactive combustion products with stable atomic structures such as CO, CO2, H2O, etc., (for a hydrocarbon based combustion).

During a combustion based polymer thermal spray process, it is desirable to avoid exposure of polymer surfaces to the visible, i.e., highly reactive, part of a flame. The visible part of a flame contains excited species of O, NO, OH, and NH ions. These free radicals can attract hydrogen from polymer surfaces causing surface oxidation and generation of polar oxygenated groups. The oxidation proceeds by a free radical mechanism accompanied by chain scission. Chain scission occurs during free radical propagation yielding polar and mobile scission products. For example, it has been found that hydroxyl, carbonyl, carboxyl, and amide groups are typically found on flame-treated polyethylene. It has been reported that a flame contact period of only 0.01-0.1 second is sufficient to oxidize, i.e., damage, polymer surface to a depth of about 40-90 Angstroms (A).

For the reasons described above, flame treatment is often used commercially to make polyolefines, polyacetales, and poly(ether terephthalate) printable and bondable by introducing polar oxygenated groups into the thin surface layer. However, during a combustion based polymer thermal spray process, coating unit building blocks are individual powder particles. If the surface of each polymer particle is exposed to an open flame and oxidized, the resulting coating will have an abundance of highly distractive free radicals and mobile scission products distributed throughout the entire coating volume. Such coatings can have significantly shortened service life due to reduced mechanical and barrier properties and an accelerated degradation kinetic. The negative effect of the visible flame on thermally sprayed polymer can be significantly minimized by utilizing thermal energy of lower temperature hot gas occurring downstream and beyond the visible flame zone.

One solution to these aforementioned problems is the use of a flameless system wherein a stream of gas is heated electrically, and the polymer and other particles are introduced into the hot gas stream. This greatly reduces burning and degradation of the coating particles and the substrate. A commercial system using this method is disclosed in PCT patent application publication WO/2008/127227, and is commercially available as the Resodyn PTS 1000 system (Resodyn Corporation, Butte, Mont.). Systems to date have used resistive heaters powered by electricity. These systems are less energy efficient than combustible fuel systems, but they avoid exposing the sprayable material to a reactive flame, or plasma, thereby yielding superior results.

For all of its advantages, the use of an electrically resistive heater to transfer heat and melt the polymer or other fusible particles has limitations. In that higher power is required in order to increase the spray output rate, such devices utilize robust sources of electricity and relatively thick copper power cables to avoid undue losses. As a result, while flameless sprayers may achieve. improved results, such sprayers are heavier and less portable than their traditional flame- and plasma-based counterparts.

What is needed is a portable, easy to wield system that can spray large quantities of melted, or partially melted, fusible polymer powder particles and/or other materials onto a substrate, which poses reduced risk degradation of such materials while achieving the necessary heat required for melting and fusing the polymer powders and other materials onto a substrate.

The background art is characterized by U.S. Pat. Nos. 3,801,020; 3,958,758; 4,416,421; 4,694,990; 5,236,327; 5,285,967; 5,503,872; 5,932,293 and 7,216,814; by U.S. Patent Applications No. US2006/166153 and US2009/095823; and by International Patent Application No. PCT/US2007/009021; the disclosures of which patents and patent applications are incorporated by reference as if fully set forth herein.

SUMMARY OF THE INVENTION

As used herein, the following terms and variations thereof have the meanings given below, unless a different meaning is clearly intended by the context in which such term is used.

"A," "an" and "the" and similar referents used herein are to be construed to cover both the singular and the plural unless their usage in context indicates otherwise.

"About," "approximately," and "in the neighborhood of" mean within ten percent of a recited parameter or measurement, and preferably within five percent of such parameter or measurement.

"Comprise" and variations of the term, such as "comprising" and "comprises," are not intended to exclude other additives, components, integers or steps.

"Exemplary," "illustrative," and "preferred" mean "another."

In an illustrative embodiment, the invention comprises a thermal spray system for depositing a polymer, or polymer composite coating, or structure onto a target substrate wherein a stream of air is heated by a flame in a defined combustion zone. In this embodiment, means are provided for the introduction of secondary gas flows into and downstream of the combustion zone that cool the combusted gas temperature below a point that would result in the degradation of the fusible polymer powders or other materials being sprayed. In this embodiment, the secondary, or excess, or dilution gas flow, may be adjusted to obtain the desired carrier gas temperature needed to process the polymer, polymer composite, or other material that is chosen for each application. The ability to adjust the carrier gas stream temperature is beneficial for successful application of the thermal spray system, as there are a broad range of fusible materials, each having different temperatures and times at which they can be processed without degradation, yet be sufficiently melted to form the desired coating and/or structure.

In this embodiment, the fusible polymer particles or other materials are introduced into the heated carrier gas stream that melts the particles while propelling them toward the target surface. In this embodiment, the flame is contained within the spray unit and does not come into contact with the target, nor does it come into contact with the fusible polymer powder particles, or other materials being thermally sprayed, or surface being coated. In this embodiment, a means for supplying coating fusible polymer powder, or other materials to the spray gun applicator is provided.

In an illustrative embodiment, the invention is a thermal spray gun, comprising: an exterior surface; an inner chamber located within the exterior surface having a forward end and an aft end; a flame source located within the inner chamber; a first fluid path located within the inner chamber for carrying a combustible mixture to the flame source, wherein the flame source produces a combustion gas when a flame is present; a second fluid path located within the inner chamber for carrying excess gas to a flame produced by the flame source; a third fluid path located between the exterior surface and the inner chamber for carrying a cooling gas to cool the exterior surface and mix with the combustion gas; and a nozzle for introducing a gas-particle mixture into the inner chamber such that the gas-particle mixture is heated by the combustion gas mixed with cooling gas as the gas-particle mixture is propelled through the inner chamber and out of the thermal spray gun. In another embodiment, the flame is anchored at the flame source. In another embodiment, the flame source is a burner plate. In another embodiment, the excess gas is directed towards the flame by a deflector located between the burner plate and the end of the nozzle closest to the forward end of the inner chamber. In another embodiment, the flame source is a perforated tube. In another embodiment, the surface area of perforations per unit length of the tube increases from the aft end of the tube to the forward end of the tube. In another embodiment, the excess gas is sufficient to substantially complete combustion of the combustible mixture. In another embodiment, the excess gas and cooling gas are drawn into the inner chamber by a fluid amplifier located at the forward end of the inner chamber relative to the flame source. In another embodiment, the fluid amplifier employs the Coanda effect. In another embodiment, the flame source is annular and the nozzle projects coaxially through the flame source. In another embodiment, at least a portion of the second fluid path is located between the nozzle and the flame source. In another embodiment, the combustible mixture is produced by a Coanda fluid flow amplifier run by an oxidant gas. In another embodiment, the combustible mixture is substantially stoichiometric with respect to fuel and oxidant present in the combustible mixture. In another embodiment, the source of the gas-particle mixture source is a fluidized bed hopper incorporating a vibrator. In another embodiment, the inner chamber is configured for preventing the flame from contacting the gas-particle mixture. In another embodiment, the gun emits the gases from the inner chamber at a velocity (rate) of less than 100 meters per second (m/s). In another embodiment, the gun emits the gases from the inner chamber at a rate of 15 to 30 m/s.

In another illustrative embodiment, the invention is a method of producing a spray polymer, comprising: introducing a combustible mixture into a flame source located in an inner chamber of a thermal spray gun through a first fluid path, wherein the thermal spray gun includes an exterior surface, and wherein the inner chamber is located within the exterior surface and has a forward end and an aft end; producing a flame at the flame source, thereby producing a combustion gas; introducing excess gas to the flame through a second fluid path located within the inner chamber;

introducing a cooling gas to cool the exterior surface and mix with the combustion gas through a third fluid path located between the exterior surface and the inner chamber; introducing a gas-particle mixture into the inner chamber through a nozzle; and heating the gas-particle mixture with the combustion gas mixed with cooling gas as the gas-particle mixture is propelled through the inner chamber and out of the thermal spray gun, thereby producing a spray polymer. In another embodiment, the method comprises anchoring the flame at the flame source. In another embodiment, the method comprises directing the excess gas towards the flame by a deflector located between the flame source and the end of the nozzle closest to the forward end of the inner chamber. In another embodiment, the method comprises introducing an amount of the excess gas sufficient to substantially complete combustion of the combustible mixture and to cool the combustion gas. In another embodiment, the method comprises drawing the excess gas and cooling gas into the inner chamber by a fluid amplifier located at the forward end of the inner chamber relative to the flame source. In another embodiment, the method comprises cooling the nozzle by locating at least a portion of the second fluid path between the nozzle and the flame source. In another embodiment, the combustible mixture is substantially stoichiometric with respect to fuel and oxidant present in the combustible mixture. In another embodiment, the method comprises preventing the flame from contacting the gas-particle mixture.

In yet another illustrative embodiment, the invention is a pre-mixer to generate a fuel-oxidant mixture for a thermal spray gun, comprising: a fluid amplifier having motive flow provided by a motive gas, thereby causing the fluid amplifier to educt an oxidant gas; and a metered inlet for a fuel fluidly connected to the fluid amplifier, wherein the pre-mixer is configured for inputting the fuel-oxidant mixture into the thermal spray gun. In another embodiment, the fuel-oxidant mixture is a substantially stoichiometric mixture. In another embodiment, the fluid amplifier is a Coanda fluid amplifier. In another embodiment, the metered inlet is a jet orifice.

In a further illustrative embodiment, the invention is a burner plate for a thermal spray gun, comprising: a perforated plate; and a second perforated material covering at least a portion of the perforated plate, wherein the burner plate is located within the thermal spray gun to produce a flame for heating gases. In another embodiment, the second perforated material is located around the perimeter of the perforated plate. Here, "around" means in a circle or in circumference.

In a further illustrative embodiment, the invention is a gas-particle mixture source comprising: a fluidized bed hopper incorporating a vibrator.

Further aspects of the invention will become apparent from consideration of the drawings and the ensuing description of exemplary embodiments of the invention. A person skilled in the art will realize that other embodiments of the invention are possible and that the details of the invention can be modified in a number of respects, all without departing from the concept. Thus, the following drawings and description are to be regarded as illustrative in nature and not restrictive.

DESCRIPTION OF THE DRAWINGS

The features of the invention will be better understood by reference to the accompanying drawings which illustrate exemplary embodiments of the invention. In the drawings:

FIGS. 12A-12D are perspective views of combustion chambers that were experimented with.

Figure 1A:
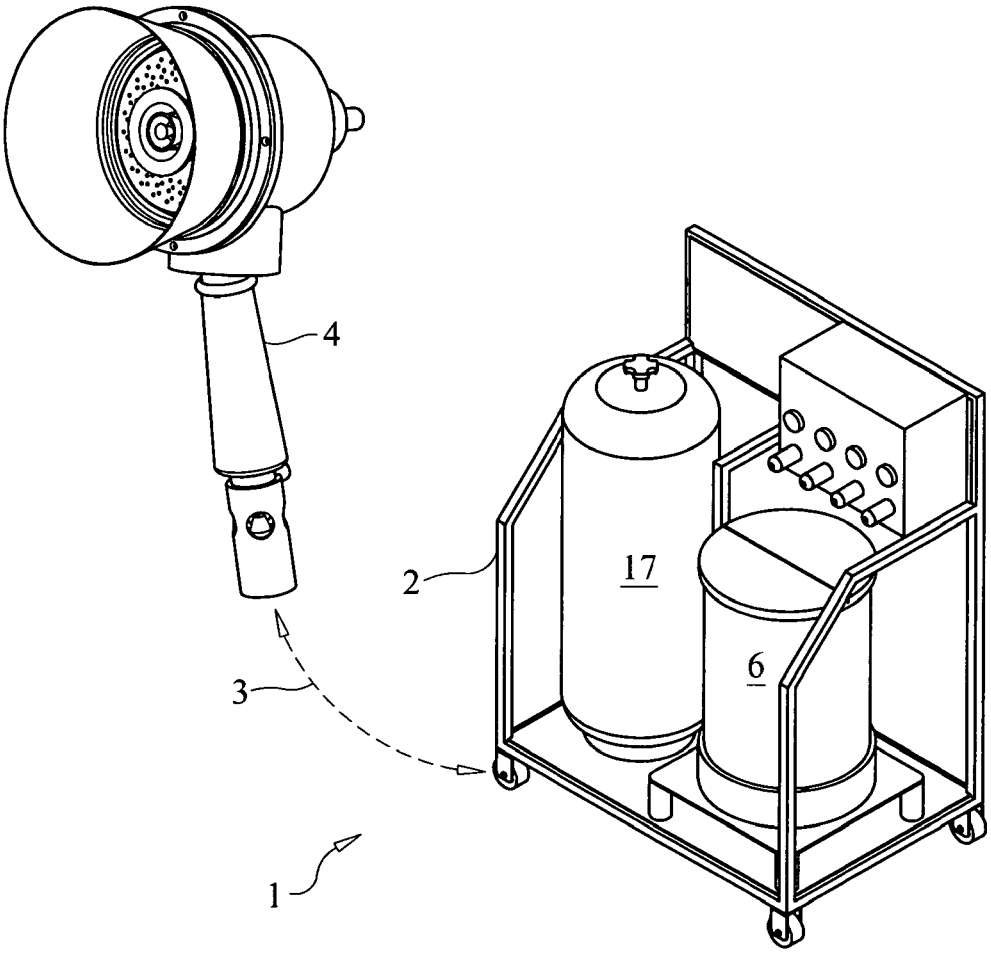
FIGS. 1A and 1B are schematic perspective diagrams of illustrative embodiments of a thermal spray system in accordance with the invention, including a spray gun applicator, material and gas supply and controls.

The following reference numerals are used to indicate on the drawings the parts and environment of an illustrative embodiment of the invention:

1 thermal spray system
2 cart
3 umbilical
4 spray gun applicator
5 air supply
6 fluidized bed hopper, hopper
7 propane/fuel and air/gas controls
8 propane/fuel, combustible fuel gas, combustible fuel, fuel gas
9 primary air, primary oxidant gas, motive air
10 mixing chamber
11 combustion chamber

12 excess air, excess oxidant gas
13 cooling or dilution air, cooling or dilution gas
14 hot carrier gas
15 burner nozzle, burner plate
16 vibrator
17 propane tank
28 powder injection nozzles/nozzle
29 fusible powder entrained in hot gas
30 fluid amplifier, second fluid amplifier
31 compressed air
32 annular manifold
33 annular nozzle
34 Coanda profile
35 low pressure area
36 pre-mix fluid amplifier, pre-mixer
52 flame/combustion gas
100 mixing and combustion step
102 flame anchoring step
104 combustion containment step
106 temperature reduction step
108 create and project carrier gas stream step
208 propane fuel gas nozzle
209 educted primary air, additional air, additional oxidant
210 combustible gas mixture
211 deflector, gas diverter
212 educted excess air
228 powder transport tube
229 powdered coating material, fusible powder
231 round hole mesh
233 square mesh

DETAILED DESCRIPTION

Figure 1B:
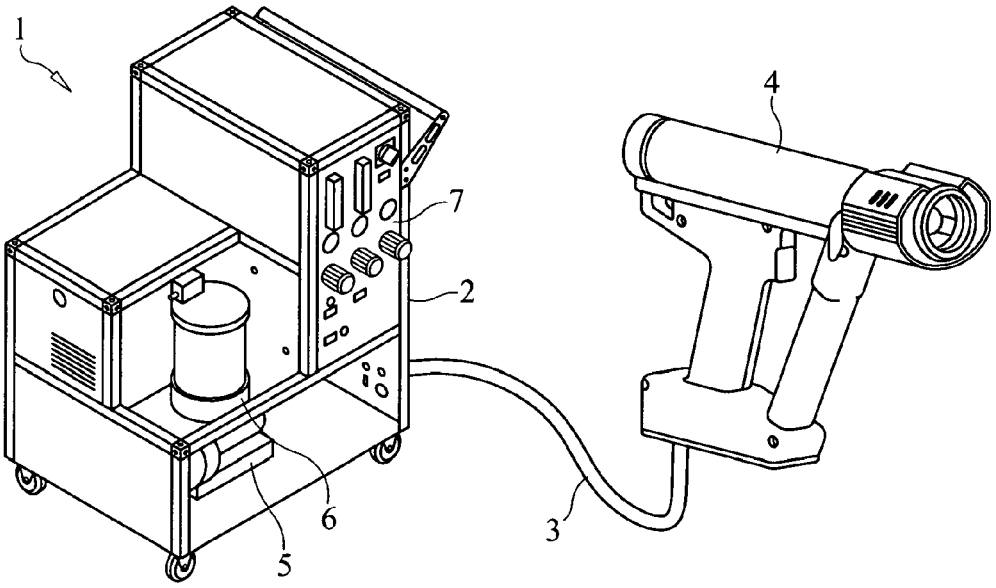

Referring to FIGS. 1A and 1B, illustrative embodiments of thermal spray system 1 are presented. In this embodiment, thermal spray system 1 includes cart 2, spray gun applicator 4 and umbilical 3 connecting spray gun applicator 4 to cart 2. Fluidized bed hopper 6 and propane tank 17 are mounted on cart 2. Spray gun applicator 4 is preferably portable and has a handle grip. In this embodiment, spray gun applicator 4 has conduits for passing powdered coating materials, combustible fuel gas, oxidant gas, excess and cooling gas and compressed air through spray gun applicator along a path or a plurality of paths. Spray gun applicator 4 also includes an assembly mounted on a distal end portion of the gun body including a nozzle for directing and controlling the hot gas flow and a channel or plurality of channels for ejecting powdered materials into the hot gas flow and a means for supplying coating material to spray gun applicator 4.

In this embodiment, material is supplied to spray gun applicator 4 by means of a fluidized bed hopper 6. The rate of supply is controlled by two venturis (not shown). The first venturi transports a stream of the powder material particles in compressed gas from fluidized bed hopper to umbilical 3. The second venturi adds additional transport air to the umbilical 3 and ejects the stream of powder material particles into spray gun 4. Each of the first venturi and second venturi is independently controlled by a different individual stream of compressed gas. Fluidized bed hopper 6 is commercially available in several hopper sizes from a number of manufacturers, such as Powder Parts Inc., Elgin, Ill. 60123.

Figure 1C:
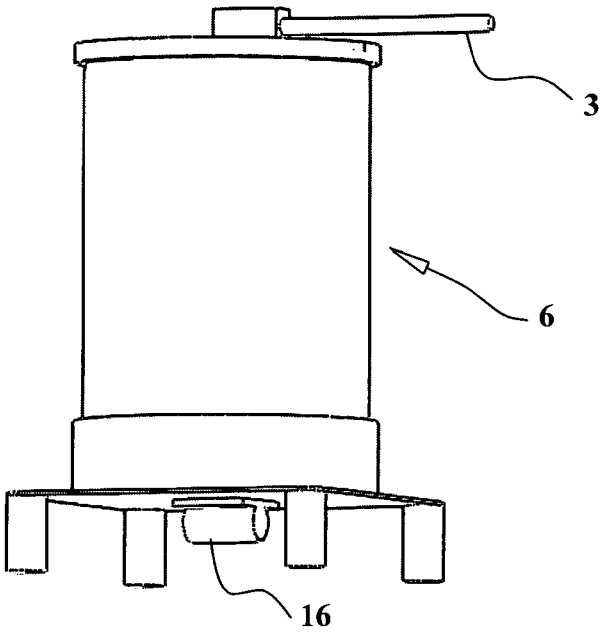
FIG. 1C is a schematic perspective diagram of an illustrative embodiment of a vibrating fluidized bed hopper providing superior powder transport capabilities

Referring to FIG. 1C, a schematic diagram of an illustrative embodiment of the invention is presented. In this embodiment, fluidized bed hopper 6 is mounted to a suspended plate to which a vibrator 16 is attached in order to vibrate the fluidized bed hopper assembly. The vibrator is added to fluidized bed hopper 6 to assist in de-agglomerating powdered materials within hopper 6 and to assist in fluidizing the powdered material. Vibrators are commonly added to powder transport systems to shake boxed powdered materials and such box shakers may be purchased from several manufacturers, such as Powder Parts Inc., Elgin, Ill. 60123. Vibrators are not added to background art fluidized bed hopper systems because the types of powder used with typical commercial powder spray equipment only requires one fluidization technique, that is, use of a box shaker to vibrate a box of powder or a fluidized bed hopper, but not both fluidization techniques.

In a preferred embodiment, a combination of vibrator 16 and fluidized bed hopper 6 provides superior powder transport capabilities. The combination is effective at de-agglomerating and fluidizing powders for transport between fluidized bed hopper 6 and spray gun applicator 4 through a powder hose within umbilical 3, with the types of thermoplastic powders used to create thermoplastic fusible coatings.

The thermal spray system described herein may be used for depositing a variety of coating materials, including zinc, aluminum, zinc-aluminum alloy, ferrous metal alloys, copper, copper alloys, ceramics, carbon, graphite and combinations thereof. They may also be used for depositing other materials, such as colorants, electrically conductive materials, fluorescent materials, phosphorescent materials, antifouling agents, reflective materials, radar absorbent materials, anti-microbials, microballoons, foaming agents, leveling agents, lubricants, ultraviolet (UV) protectors and combinations thereof. Still other materials suitable for deposition using thermal spray system 4 include thermoplastic or thermoset polymeric materials, such as epoxy resins, polyurethanes, polyethers, nylons, polyesters, polycarbonates, polyethylene, polypropylene, acrylic polymers, polyvinylchloride (PVC) resins, fluorocarbon polymers, ethylenevinylacetate (EVA), ethyleneacrylicacid (EAA), acrylonitrilebutadienestyrene (ABS), polyetheretherketone (PEEK), Polyvinylidenfloride (PVDF), silicones and chemical or physical combinations thereof. Coating materials may be combined with other materials. Particle sizes for the coating materials may range from about 5 microns to about 5,000 microns.

Figure 2:
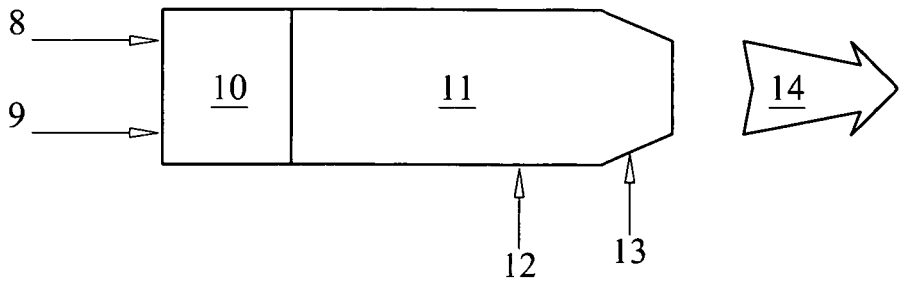
FIG. 2 is a schematic block diagram of an illustrative embodiment of a heater system which produces a hot gas carrier stream.

Referring to FIG. 2, a schematic diagram of an illustrative embodiment of the invention is presented. In this embodiment, combustible fuel 8, typically a gas, for example, propane, and oxidant 9, typically air, are mixed prior to combustion chamber 11 (e.g., in mixing chamber 10) or within combustion chamber 11, at near (approximately) stoichiometric ratios. As used herein, the stoichiometric ratio is the exact ratio of fuel molecules that will combine with oxidant molecules to yield a complete combustion reaction. Combustible fuel 8 and oxidant 9 may also be mixed at sub-stoichiometric ratios (rich in combustion fuel 8) with additional oxidant 9 brought in later in order to complete the combustion reaction. Combustion occurs within combustion chamber 11 and produces combustion products. Excess air or other gas 12 is next introduced to the combustion process in order to complete combustion and begin the' cooling of the combustion products. Cooling or dilution gas 13, typically air, is finally introduced near the forward end of combustion chamber 11 to reduce the gas temperature to the final desired process temperature and to produce hot carrier gas stream 14. Here, "near" means located closely in space to the object it precedes. In addition to propane, other gaseous fuels, such as acetylene, butane, isobutane, hydrogen, or natural gas may be used as the combustible fuel, as well as atomized, or vaporized liquid fuels such as kerosene, white gasoline or diesel fuel.

Figure 3:
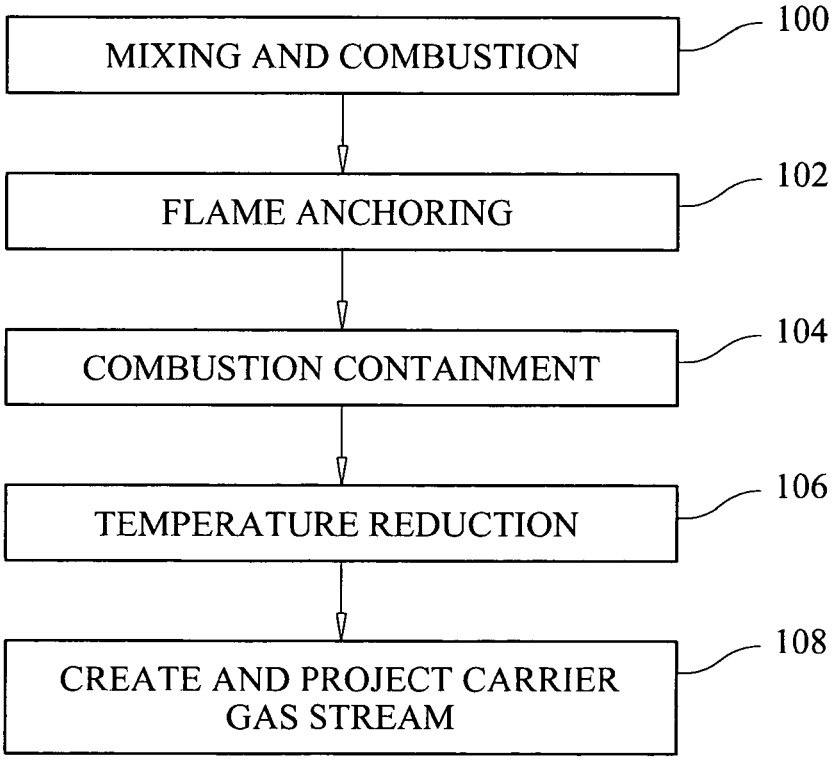
FIG. 3 is a schematic flow diagram of a thermal spray process in accordance with an illustrative embodiment of the invention.

Referring to FIG. 3, a process flow diagram of an illustrative embodiment of the invention is presented. In this embodiment, there are five steps involved in creating a flameless heat suitable for processing polymer powders using a combustion process. First, in mixing and combustion step 100, fuel 8 and oxidant 9 are mixed within an appropriate range of ratios (fuel/oxidant) and exposed to a critical ignition temperature which causes combustion to occur. Second, in flame anchoring step 102, the flame from combustion is "anchored" in order to provide a stable ignition temperature for the combusting mixture. Third, in combustion containment step 104, combustion products are contained within an enclosed or partially enclosed volume. Fourth, in temperature reduction step 106, the temperature of the combustion products is reduced to the desired process temperature. Fifth, in create and project carrier gas stream step 108, a carrier gas stream having the appropriate process temperature is created and projected from the outlet of the heater unit, preferably toward a target.

In the embodiment of FIG. 3, in order to achieve appropriate process temperature conditions, the flame is anchored within the combustion chamber. Otherwise, the flame would exit the nozzle and either extinguish due to overly lean conditions, or burn outside of the nozzle, causing the fusible particles to degrade as explained above. In order to anchor a flame, the velocity of fuel/oxidant gas mixture is reduced to a level at which the combustion reaction can occur and a proper residence time is provided for the combustion reaction to complete. Velocity reduction is achieved in certain embodiments disclosed herein by influencing back flowing eddies in the gas stream through the use of a burner nozzle. The burner nozzle may be of the form of a blast nozzle or that of a perforated flame anchoring plate within an enclosed or partially enclosed volume.

A person having ordinary skill in the art would know that a variety of other flame anchoring means are used in flame systems, such as stoves and fueled jets. These flame anchoring means may also be incorporated into embodiments of the invention. Thus, the foregoing examples provide a basic insight into the process of flame anchoring and should not be construed as limitations on the invention.

The heat of combustion at stoichiometric conditions for burning propane in air is 1,980° C. This temperature is too high to be contained by most common refractory materials. For example, high temperature steel alloys have a service temperature of 537° C. Nickel-chromium-iron alloys are used up to 677° C. Even ceramic coated jet engine parts only operate at a maximum temperature of 1,371° C. Therefore, background art flame generating devices are configured so that the flame burns outside the device architecture in free air. For these reasons, in certain embodiments of the invention, in order to contain combustion, film cooling on the flame containment surfaces and heat transfer management are employed.

The desired process temperature for a thermoplastic sprayer device is a hot gas temperature that exits the device in the neighborhood of 700° C., but could range from 100° C. to around 1,000° C. Here, "around" means "approximately" as it is defined above. Most fusible materials are processed in this temperature range. Because combustion temperatures are much higher than preferred fusible material processing temperatures, and to provide a stream of heated carrier gas, in illustrative embodiments of this invention, excess air 12 and cooling gas 13 are introduced to the process during combustion and after combustion is completed.

Figure 4:
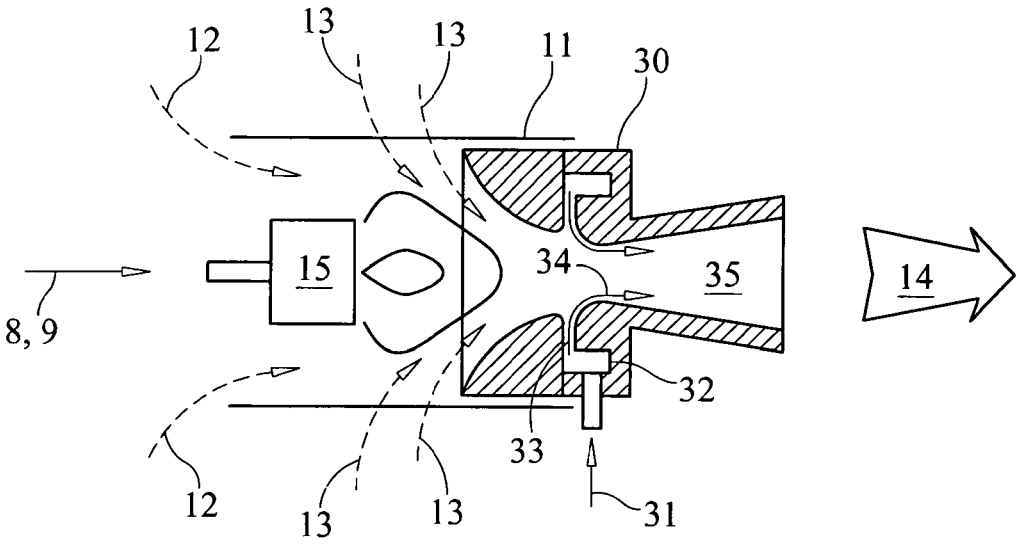
FIG. 4 is a schematic diagram depicting an illustrative embodiment of means for using a fluid amplifier geometry to supply excess combustion air and dilution cooling air using a small supply of compressed air relative to the total air requirement.

Referring to FIG. 4, a schematic diagram of burner nozzle 15 contained within combustion chamber 11 shows how excess air 12 and cooling air 13 may be supplied by fluid amplifier 30. In this embodiment, fuel gas 8 and oxidant 9 enter burner 15 from the left. Compressed air 31 enters via annular manifold 32. Compressed air 31 is throttled through an annular nozzle 33 at a high velocity to create a primary airstream. This primary air stream adheres to a Coanda profile 34, which is an annular convex curve in this case. A low pressure area is created at the center 35 which induces (draws) a high volume of surrounding excess air 12 and cooling air 13, into the air stream, thus amplifying the primary air flow rate typically by an order of magnitude. The compressed air along with the induced air supplies the total excess air 12 and cooling air 13 required to produce flameless hot carrier gas 14 without requiring a high volume blower, i.e., a relatively small amount of compressed air becomes adequate for supplying much larger amounts of excess combustion and cooling air.

Coanda or attached flow fluid amplifiers are known in the art of fluidics. It is the coupling of a fluid amplifier to a burner or flame tube located within combustion chamber 11 that provides at least two functions. First, excess air 12 serves to complete combustion and begin cooling the flame. Second, the cooling or dilution air 13 serves to further reduce the temperature of the combustion products to achieve the desired flameless hot carrier gas for processing of polymer powders or other materials. Both described functions are accomplished using relatively low quantities of compressed air by means of a Coanda fluid amplifier.

Figure 5:
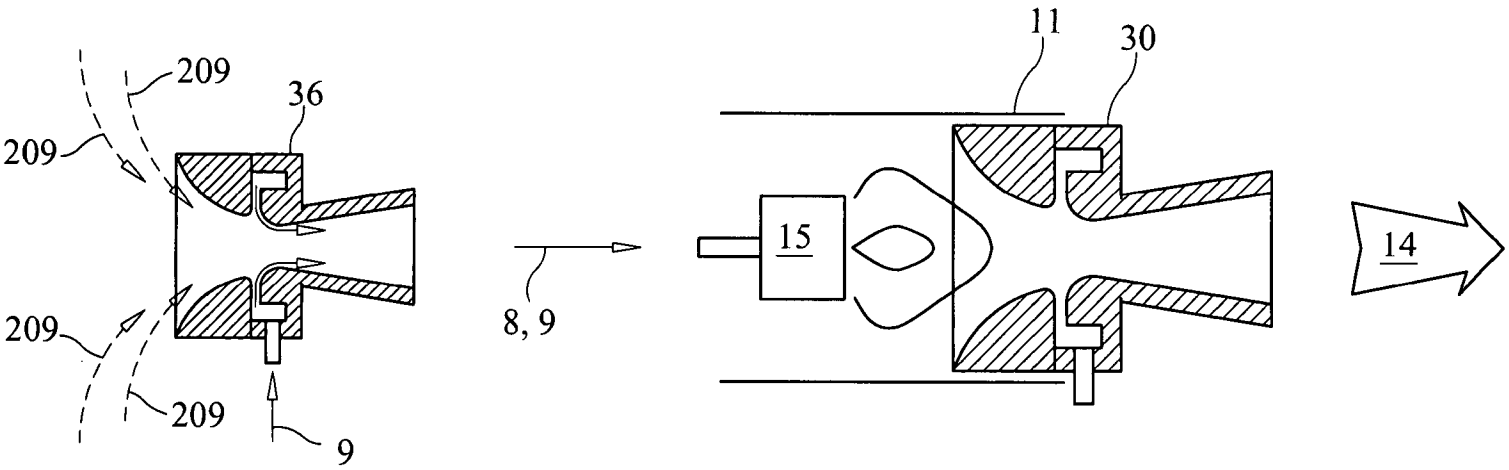
FIG. 5 is a schematic diagram depicting an illustrative embodiment of means for using a fluid amplifier geometry to supply and pre-mix oxidant and fuel to a combustion apparatus.

Referring to FIG. 5, a schematic diagram of an illustrative embodiment of the invention is presented showing how a Coanda pre-mix fluid amplifier 36 may serve to pre-mix fuel gas 8 and oxidant 9. Fuel gas 8, such as propane, is metered through propane fuel gas nozzle 208 to pre¬mix fluid amplifier 36 acting as a pre-mixer. Motive air 9 is introduced to pre-mix fluid amplifier 36 and as previously described, the geometry of the pre-mix fluid amplifier 36 draws in additional fluid, in this case additional oxidant 209, e.g., air. Pre-mixed fuel/oxidant 8, 9 is then delivered via a first fluid path to a flame source, e.g., burner 15, located inside a combustion chamber 11, said combustion chamber being located within an exterior surface. A second fluid amplifier 30, previously discussed, may then be used to reduce the temperature of the combustion products (e.g., a combustion gas) in order to produce hot carrier gas 14.

Background art venturi style eductors generally do not provide enough primary air to create a stoichiometric mixture and therefore tend to burn rich and require additional oxidant air at the burner. This problem is solved by the applicants by de-coupling the propane gas flow 8, which is typically the motive flow in a pre-mix venturi eductor, from the air venturi and instead using an independent Coanda pre-mix fluid flow amplifier 36, run by primary air 9 and educting additional air 209, in combination with propane fuel gas nozzle 208, e.g., a propane jet orifice, that discharges into the entrance of pre-mix fluid amplifier 36.

Figure 6:
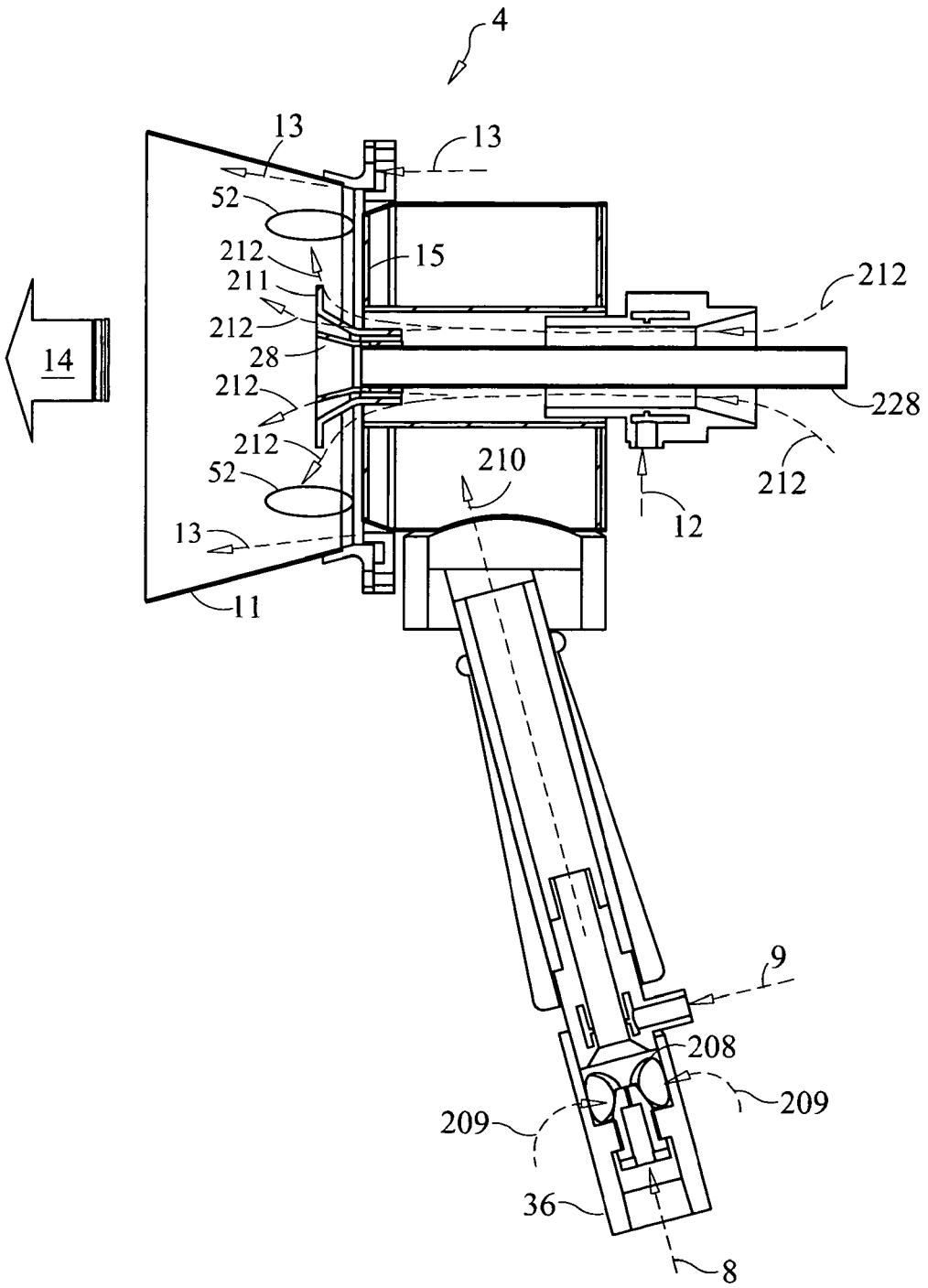
FIG. 6 is a schematic cross-sectional view of a preferred embodiment of a spray gun applicator for a thermal spray system in accordance with the invention. This view illustrates how a hot carrier gas is created in this embodiment of the invention.

Referring to FIG. 6, an illustrative embodiment is presented that incorporates many of the features discussed previously into hand held spray gun applicator 4. In this embodiment, propane 8 is throttled through a propane fuel gas nozzle 208 into pre-mix fluid amplifier 36. Primary air 9 is introduced to the pre-mix fluid amplifier 36 and, through fluid amplification, additional primary air 209 is educted into pre-mix fluid amplifier 36 where the gases are mixed to create a stoichiometric combustible gas mixture 210. Combustible gas mixture 210 is introduced to mixing chamber 10 which functions as a plenum to uniformly distribute combustible gas mixture 210 across burner plate 15 via a first fluid path. A flame, flame front, or series of smaller flames 52 is created and is anchored by the burner plate 15, burner plate 15 thereby acting as a flame source. Motive excess air 12 is used with second fluid amplifier 30 to educt additional excess air 212 into and through the center of spray gun applicator 4 via a second fluid path. Excess air 12, 212 is drawn around powder transport tube 228 and flows to deflector 211. Here, "around" means on all or various sides. Deflector 211 diverts excess air 12, 212 into flame 52. Excess air 12, 212 is mixed with flame 52 which insures complete combustion and begins to cool the combustion gas. Deflector 211 also diverts excess air 12, 212 across powder injection nozzle 28 and keeps the nozzle 28 cool so that powdered coating materials do not stick to and foul the nozzle 28. Cooling or dilution air 13 is emitted through an annular orifice via a third fluid path, which serves to keep the walls of combustion chamber 11 and the exterior surface of thermal spray gun 4 from overheating and to further cool the combustion products/combustion gas and create hot carrier gas 14.

Figure 7:
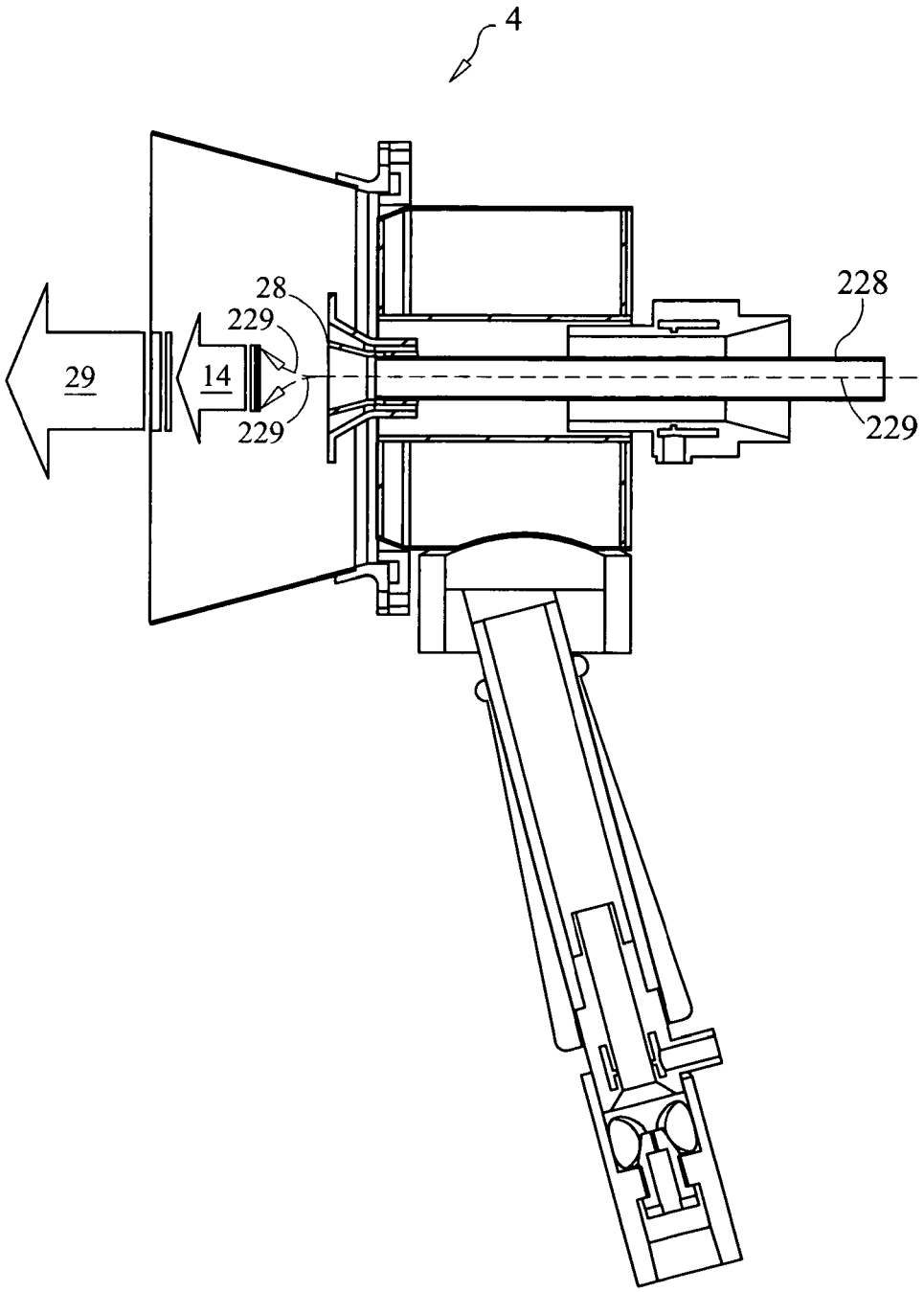
FIG. 7 is a cross-sectional view of a preferred embodiment of a spray gun applicator for a thermal spray system in accordance with the invention. This view illustrates how fusible powder is entrained into a hot carrier gas in the embodiment of the invention presented in FIG. 6.

Referring to FIG. 7, a diagram is presented that illustrates how a gas-particle mixture, e.g., fusible powder 229, is entrained in hot carrier gas 14 in the embodiment of the spray gas applicator presented in FIG. 6. Fusible powder 229 is transported though powder transport tube 228 to powder injection nozzle 28. Fusible powder 229 then mixes with hot carrier gas 14 and becomes fusible powder entrained in hot gas 29.

Figure 8A:
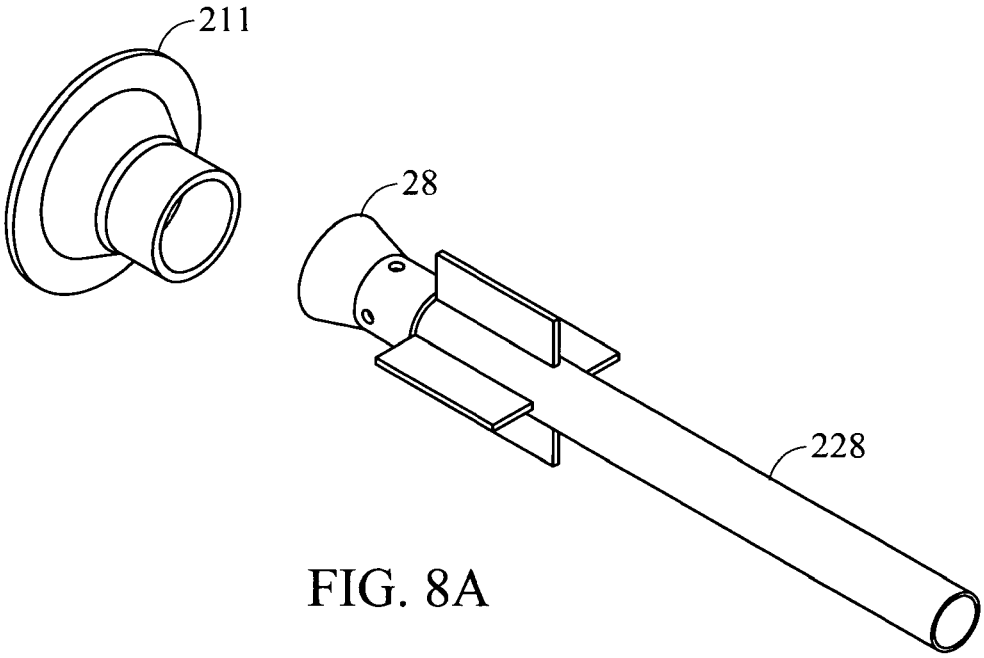
FIG. 8A is an exploded isometric view of a preferred embodiment of means for deflecting or diverting excess air into a flame and across a powder injection nozzle.

Referring to FIG. 8A, an exploded isometric view of a preferred embodiment of air deflector 211, powder nozzle 28 and powder transport tube 228 is presented. Air deflector 211 serves to mix excess air 12, 212 with the flame in order to rapidly complete combustion and allow the flame to remain within combustion chamber 11.

Figure 8B:
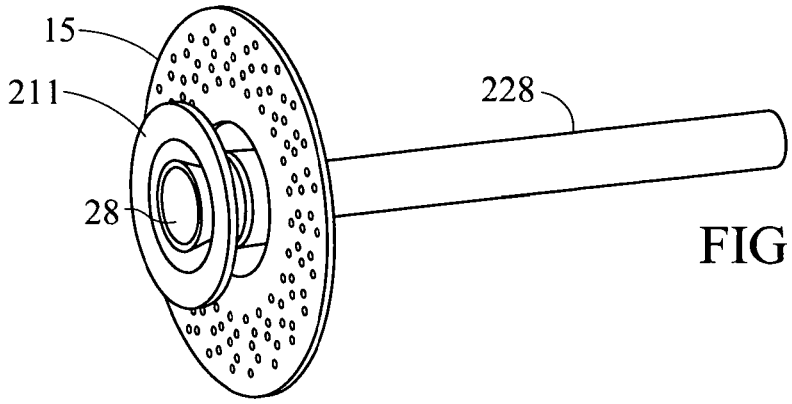
FIG. 8B is a perspective view of a preferred embodiment of a subassembly comprising a powder nozzle, a powder tube, a deflector and a burner plate.
Figure 8C:
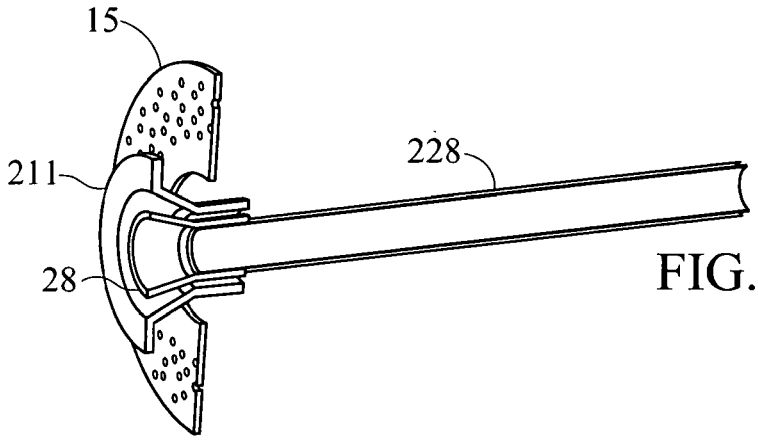
FIG. 8C is a cross sectional view of the subassembly shown in FIG. 8B.

Referring to FIG. 8B a perspective view of a preferred embodiment of a subassembly comprising powder nozzle 28, powder tube 228, deflector 211 and burner plate 15 is presented. FIG. 8C presents a cross sectional view of the subassembly shown in FIG. 8B. In this embodiment, powder nozzle 28 is disposed concentric to and attached to powder tube 228. Deflector 211 is disposed concentric to powder nozzle 28. There is an annular space between deflector 211 and powder nozzle 28 to allow for gas flow. Burner plate 15 is disposed concentric to deflector 211. There is also an annular space between burner plate 15 and deflector 211 to allow for gas flow. There is also a standoff space between burner plate 15 and deflector 211 to allow for gas flow.

Figure 9A:
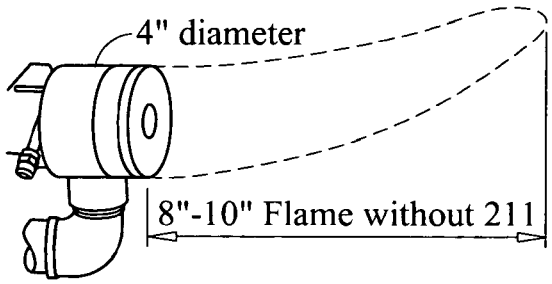
FIG. 9A is a diagram showing flame length without an air deflector
Figure 9B:
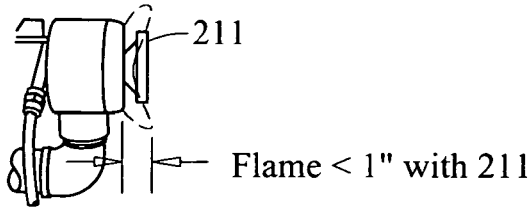
FIG. 9B is a diagram illustrating the flame shorting effect of the air deflector.

Referring to FIGS. 9A and 9B, schematic diagrams are presented that show that without air deflector 211, the flame is 8 inches to 10 inches long when operating at 120,000 BTU per hour. With the air deflector 211 the flame is reduced to approximately 1 inch long when operating at 120,000 BTU per hour.

Figure 10:
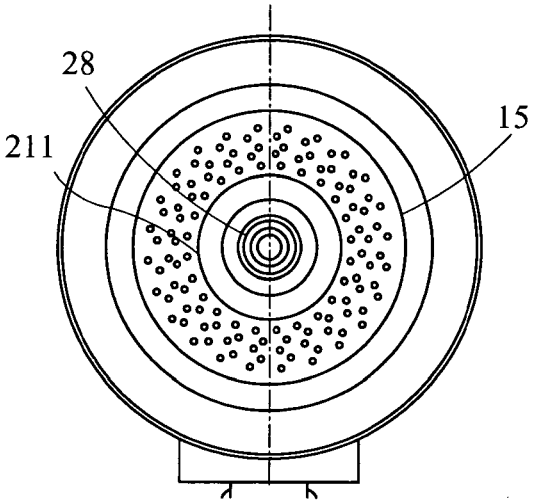
FIG. 10 is a front elevation view of a preferred embodiment of a spray gun applicator with an annular burner plate disposed coaxially to a powder injection nozzle and excess air deflector.
Figure 11A:
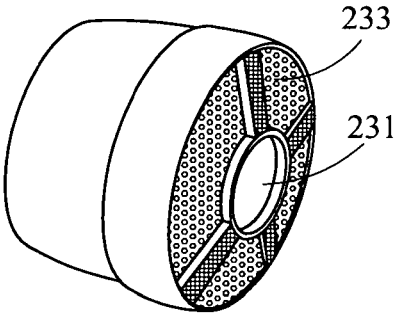
FIGS. 11A and 11B are diagrams that illustrate burner plates geometries that mitigate combustion noise.
Figure 11B:
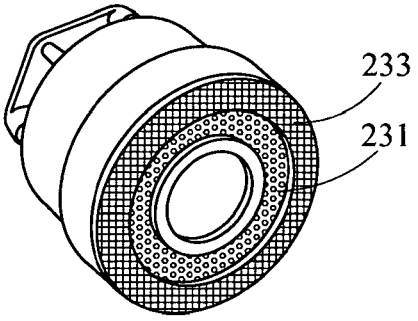

Referring to FIG. 10, a front elevation view of an embodiment of spray gun applicator comprising burner plate 15, deflector 211 and powder injection nozzle 28 is presented. FIGS. 11A and 11B show burner plate designs that mitigate burner noise. Burner noise is problematic with many burner designs and becomes evident as loud screech noises. The applicants discovered that burner plate geometries that served to "break-up" the flat face of burner plate 15 were effective at mitigating noise. FIG. 11B illustrates a preferred embodiment. In this view, burner plate 15 is a combination of perforated round hole mesh 231 in combination with an annular ring of square hole mesh 233 around the perimeter. FIG. 11A shows a geometric configuration that works to some extent but not as well as the preferred embodiment shown in FIG. 11B.

Figure 12A:
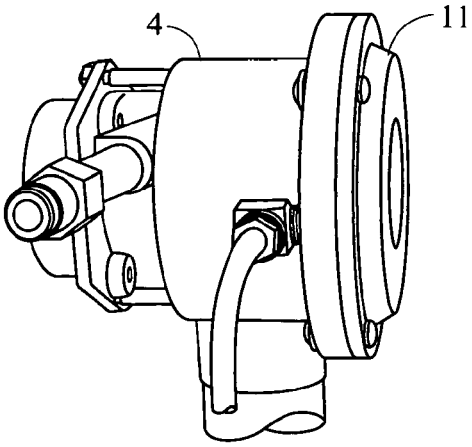
Figure 12B:
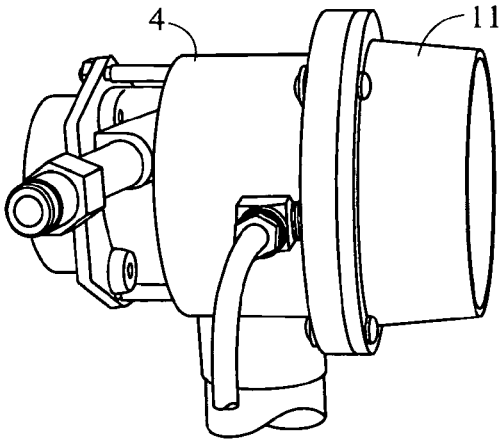
Figure 12C:
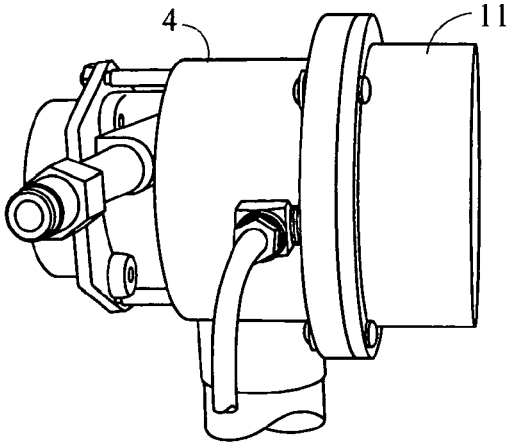
Figure 12D:
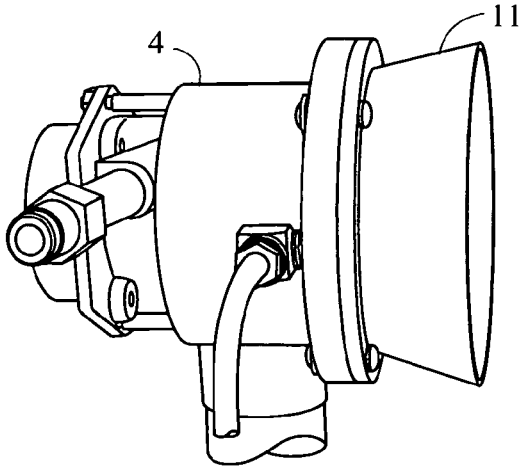

Referring to FIGS. 12A-12D, the applicants discovered that the shape of the semi-enclosed combustion chamber 11 was important in keeping the flame from exiting the chamber and in preventing the powder injection nozzle 28 from heating up. A preferred embodiment of combustion chamber 11 has the shape of a diverging frustum of a cone as illustrated in FIG. 12D.

This shape was determined through experimentation with converging, straight, and diverging shapes of different lengths. The shape of the diverging cone enables the hot gases from combustion chamber 11 to expand. Hence, the flame is not propelled out of combustion chamber 11 but stays anchored to burner plate 15. The applicants also discovered that the diverging shape also discouraged the heating up of powder nozzle 28. In contrast, straight walled and converging shapes for combustion chamber 11 caused powder nozzle 28 to heat up and foul with fusible powder.

Many variations of the invention will occur to those skilled in the art. Some variations include trip plates, trip lips and/or bluff bodies. Other variations call for flame tubes holes or perforated walls, serpentine paths and/or fluid amplifiers with annular nozzles and/or air knives. All such variations are intended to be within the scope and spirit of the invention.

Although some embodiments are shown to include certain features, the applicants specifically contemplate that any feature disclosed herein may be used together or in combination with any other feature on any embodiment of the invention. It is also contemplated that any feature may be specifically excluded from any embodiment of the invention.

What is claimed:

1. A thermal spray gun, comprising:

an exterior surface;

an inner chamber located within the exterior surface having a forward end and an aft end;

a flame source located within the inner chamber;

a first fluid passageway located within the inner chamber for carrying a combustible mixture to the flame source, wherein the flame source produces a combustion gas when a flame is present;

a second fluid passageway located within the inner chamber for carrying excess gas to a flame produced by the flame source;

a third fluid passageway located between the exterior surface of the thermal spray gun and a wall of the inner chamber of the thermal spray gun, wherein the third fluid passageway is configured to carry a cooling gas to cool the exterior surface and to carry the cooling gas to the inner chamber to mix with the combustion gas;

a nozzle for introducing a gas-particle mixture into the combustion gas mixed with the cooling gas; and a deflector positioned adjacent a distal end of the second fluid passageway and extending radially outward therefrom;

wherein the deflector is configured to direct the excess gas at least partially across the flame source;

wherein an outlet of the third fluid passageway is located downstream from the flame source and between the flame source and an outlet of the nozzle.

2. The thermal spray gun of claim 1, wherein the flame is anchored at the flame source.

3. The thermal spray gun of claim 2, wherein the flame source is a burner plate.

4. The thermal spray gun of claim 3, wherein the burner plate comprises a perforated plate and a perforated material covering at least a portion of the perforated plate.

5. The thermal spray gun of claim 4, wherein the perforated material is located around a perimeter of the perforated plate.

6. The thermal spray gun of claim 1, wherein the distal end of the second fluid passageway includes two annular spaces formed on both sides of the deflector.

7. The thermal spray gun of claim 1, wherein the flame source is positioned concentric to the deflector.

8. The thermal spray gun of claim 1, comprising a fluid amplifier located at the forward end of the inner chamber relative to the flame source, wherein the excess gas and cooling gas are drawn into the inner chamber by the fluid amplifier.

9. The thermal spray gun of claim 8, wherein the fluid amplifier comprises a first Coanda fluid amplifier.

10. The thermal spray gun of claim 9, wherein the first Coanda amplifier is configured to deliver compressed air to the inner chamber to create a primary stream that adheres to a Coanda profile.

11. The thermal spray gun of claim 1, wherein at least a portion of the second fluid path is located between the nozzle and the flame source.

12. The thermal spray gun of claim 1, wherein the inner chamber is configured for preventing the flame from contacting the gas-particle mixture.

13. The thermal spray gun of claim 1, wherein the thermal spray gun emits the gases from the inner chamber at a rate of less than 100 meters per second.

14. The thermal spray gun of claim 1, further comprising a pre-mixer to provide the combustible gas mixture to the inner chamber, wherein the pre-mixer comprises a pre-mix fluid amplifier.

15. The thermal spray gun of claim 14, wherein the pre-mixer fluid amplifier is configured to generate the combustible mixture.

16. The thermal spray gun of claim 15, wherein the pre-mix fluid amplifier includes a second Coanda fluid amplifier.

17. The thermal spray gun of claim 1, wherein the inner chamber comprises a combustion chamber and a mixing chamber.

18. The thermal spray gun of claim 17, wherein the first fluid passageway is configured to deliver the combustible mixture from the mixing chamber to the combustion chamber, wherein the flames source is located within the combustion chamber.

* * * * *